United States Patent [19]

Piersall

[11] Patent Number: 4,592,687

[45] Date of Patent: Jun. 3, 1986

[54] ROOF BOLT

[76] Inventor: Raymond Piersall, 927 Edgar St. Space 10, Beaumont, Calif. 92223

[21] Appl. No.: 757,616

[22] Filed: Jul. 22, 1985

[51] Int. Cl.[4] ..... F21D 21/00; F16B 13/06

[52] U.S. Cl. ..... 411/4; 405/259; 411/40; 411/55; 411/60

[58] Field of Search ..... 405/259–262; 411/2–4, 39, 40, 44, 45, 55, 57, 60, 72

[56] References Cited

U.S. PATENT DOCUMENTS

| | | | |
|---|---|---|---|
| 2,159,580 | 5/1939 | Zifferer | 411/51 |
| 2,165,656 | 7/1939 | Ryan | 411/4 |
| 2,218,581 | 10/1940 | Levan | 411/55 X |
| 2,408,559 | 10/1946 | Keating | 411/17 |
| 2,647,431 | 8/1953 | Lewis | 411/53 |
| 3,104,582 | 9/1963 | White | 411/60 |
| 3,188,815 | 6/1965 | Schuermann et al. | 405/261 |
| 3,191,486 | 6/1965 | Gibbens | 411/4 |
| 3,211,044 | 10/1965 | White | 411/60 |
| 3,267,792 | 8/1966 | Yackle | 411/4 |
| 3,315,557 | 4/1967 | Dickow | 411/47 |
| 4,173,918 | 11/1979 | Piersall | 411/51 |
| 4,483,645 | 11/1984 | White et al. | 405/261 |

FOREIGN PATENT DOCUMENTS

| | | |
|---|---|---|
| 985537 | 3/1976 | Canada . |
| 2547634 | 4/1977 | Fed. Rep. of Germany . |
| 746524 | 9/1933 | France . |
| 1179556 | 12/1958 | France . |
| 84373 | 10/1954 | Norway . |
| 218367 | 1/1968 | Sweden . |

*Primary Examiner*—David H. Corbin

*Attorney, Agent, or Firm*—Klein & Szekeres

[57] ABSTRACT

An expansion bolt, particularly adapted for supporting the roof of a mine tunnel, includes an elongate stud having distal and proximal threaded ends. Coaxially mounted on the stud near the distal end is an expansion sleeve that is axially divided into a plurality of circumferentially-spaced sleeve segments. A cam element is threadedly attached to the distal stud end. The cam element is formed of a sheet metal stamping; and includes an annular collar with a plurality of circumferentially-spaced fingers extending proximally from the periphery of the collar. The fingers also taper radially outwardly to give the cam element a frusto-conical configuration. The proximal ends of the fingers engage the interior surface of the sleeve near the distal end of the sleeve. The sleeve is constrained from axial movement on the stud, and the stud is rotatable independently of the cam element and the sleeve. The proximal end of the sleeve has a nut adapted for the application of a torque thereto. The nut is attached to the stud by a shear pin that allows the nut and the stud to turn together until a predetermined torque level is reached. Rotation of the stud flattens the cam element axially, causing its fingers to spread radially outwardly against the sleeve segments, camming the latter in a radially outward direction. When the predetermined torque is applied, the nut is advanced axially on the stud toward the distal end, bringing the nut into engagement with a pressure plate carried on the stud between the nut and the sleeve.

20 Claims, 4 Drawing Figures

ROOF BOLT

BACKGROUND OF THE INVENTION

1. Field of the Invention

This invention relates generally to the field of expansion bolts. More particularly, the present invention relates to the class of expansion bolts, known as "roof bolts", that are anchored in rock formations in underground tunnels and the like to provide structural support for the roof of the tunnel.

2. Brief Description of the Prior Art

Expansion bolts and similar devices have long been used in mining operations to provide strutural support for the ceiling or roof of a mine tunnel and to support loads (such as slusher buckets, for example) that are suspended from the tunnel roof. Of primary importance, however, is the function of supporting the mine roof against collapse. To this end, a long hole of predetermined diameter is drilled into the structural layers of rock and the like forming the roof of the tunnel. These holes are usually several feet in length, with seven feet (or somewhat more than 2 meters) being a typical length. An expansion bolt is inserted into the hole, the expansion bolt having an expansion portion at the innermost, or distal end of the hole, and a rock plate surrounding the outer opening of the hole.

Proper installation of a roof bolt is critical to its proper functioning. To this end, it is necessary to assure that the bolt engages the walls of the pre-drilled hole with substantially uniform force throughout the circumference of the expansion portion, thereby minimizing the chances of slippage Proper design of the expansion portion, as well as proper tightening of the bolt, help accomplish this function.

Prior art expansion bolts typically employ a split sleeve as the expansion portion, with the split portions of the sleeve being cammed outwardly by a wedge member as the bolt is tightened. The outwardly-cammed sleeve portions engage the walls of the hole. A problem with many expansion bolts of this general design is that of assuring an even application of pressure around the circumference of the expansion sleeve. For example, one split portion may deform excessively as the bolt is tightened. The result may be reduced stability and an increased possibility of slippage.

Another problem frequently encountered with prior art roof bolts stems from the fact that such bolts must perform two functions that may be at odds with one another. The first function is that of placing a radial pressure against the walls of the hole at or near its distal end. The second function is that of applying a slight pressure between the deeply anchored distal end of the bolt and its outer or proximal end, thereby placing the rock layer or layers there between in compression, with a corresponding longitudinal tension being placed on the bolt itself. These two functions may conflict, for example, if the expansion portion of the bolt locks it into a longitudinal position wherein there is insufficient longitudinal tension on the bolt. This condition would result if the head (proximal end) of the bolt were not drawn snugly against the rock shoulder surrounding the opening of the pre-drilled hole before the bolt became anchored in the hole by its expansion portion.

A roof bolt designed to overcome these problems is disclosed and claimed in U.S. Pat. No. 4,173,918, issued to Raymond Piersall, the applicant of the present application. The roof bolt disclosed and claimed in this previous patent includes an elongate stud having distal and proximal threaded ends, with a cylindrical, axially slotted sleeve mounted near the distal end. The distal end carries a frusto-conical wedge adapted to enter the distal end of the sleeve as the bolt is tightened, forcing the slotted sleeve portions to expand outwardly in response to the relation of the stud. The proximal end of the stud carries a nut, which is attached to the stud so as to be held in a fixed rotational position relative thereto until a predetermined torque is applied to the nut. A rock plate is carried on the stud between the nut and the sleeve. This design assures a uniform radial pressure applied by the expansion sleeve. In addition, the attachment of the nut to the stud allows the bolt to be longitudinally tensioned, by means of the pressure applied by the rock plate around the opening of the hole, after its expansion sleeve has been properly located and anchored.

Although the above-described device accomplishes its desired purpose, further improvements are desirable. For example, the wedge member in the above-described invention comprises a solid piece of steel alloy, machined to its proper dimensions and its frusto-conical shape. The need to fabricate this element by machining adds greatly to the cost of the roof bolt. Secondly, in some applications, a greater degree of expansion may be desired than can be easily accomplished by the wedge mechanism. With lower cost, and greater versatility, the range of applications for a roof bolt in accordance with this general concept can be expanded.

SUMMARY OF THE INVENTION

Broadly, the present inventions is an expansion bolt comprising an elongate stud having distal and proximal threaded ends, with a cylindrical, axially-slotted sleeve mounted near the distal end. Threadedly attached to the distal end is a cam element having a plurality of circumferentially-spaced fingers that taper outwardly as they extend proximally into the interior of the sleeve. A nut is threadedly attached to the proximal end of the stud with attachment means that hold the nut and the stud in a fixed rotational relationship until a pre-determined torque is applied to the nut. A pressure plate, or rock plate, having a width greater than the diameter of the hole into which the bolt is inserted, is carried on the stud between the nut and the sleeve.

More particularly, the expansion bolt in accordance with the present invention employs an expansion sleeve having a plurality of circumferentially-spaced axial slots extending from its distal end to a point spaced from its proximal end. The inner surface of the sleeve carries a radially-inwardly extending shoulder at an axial location proximally spaced from the distal end of the sleeve. The sleeve is restrained from axial movement in a proximal direction on the stud by a retaining member carried on the stud that engages the proximal end of the sleeve. The retaining member, however, allows the stud to rotate independently of the sleeve. The cam element is formed from a sheet of resilient metal (e.g. steel) alloy, and is generally frusto-conical in shape, with a greater circumference at its proximal end than at its distal end. The proximal ends of the fingers extend into the distal end of the sleeve, engaging the shoulder therein. The engagement between the cam element and the shoulder constrains the cam element from rotating with the stud.

When the distal end of the bolt is inserted into a pre-drilled hole in the mine roof, the nut is rotated in a tightening direction. The attachment means between the nut and the stud causes the stud to rotate likewise. The threaded engagement between the stud and the cam element, and the engagement between the cam element and the shoulder in the sleeve, cause the fingers of the cam element to be ever more tightly urged against the shoulder in the sleeve. Because the sleeve is restained from axial motion, the tightening action tends to flatten the cam element, spreading its fingers radially outwardly against the slotted portion of the sleeve. The slotted portion of the sleeve is thereby cammed by the cam element in a radially-outward direction to apply a radial pressure to the wall of the hole. When this radial pressure reaches a pre-determined level, the torque needed to continue rotating the nut exceeds the value against which the attachment means between the nut and the stud hold the two elements in a fixed rotational relationship. The nut can then be advanced axially on the stud in a distal direction to bring the rock plate to bear against the shoulder of rock surrounding the opening of the hole. In this manner, the bolt is tensioned longitudinally to the appropriate degree after the expansion sleeve is properly located and expanded, thereby allowing the independent adjustment of radial pressure against the walls of the hole and of the longitudinal compression of the rock layer or layers through which the hole extends.

As will be understood more fully from the detailed description which follows, the present invention allows accurate positioning of the expansion portion of the bolt, while providing a firm anchoring grip through the even distribution of radial pressure around the expansion portion. In addition, sufficient longitudinal compression of the rock layer or layers is easily accomplished. These advantageous qualities are achieved with a bolt structure that is simple and economical to manufacture, as compared to prior art designs. In addition, a relatively large degree of expansion can be achieved with somewhat lower torque applied to the stud, thereby extending the range of applications for roof bolts of this general design.

DETAILED DESCRIPTION OF A PREFERRED EMBODIMENT OF THE INVENTION

Figure 1:
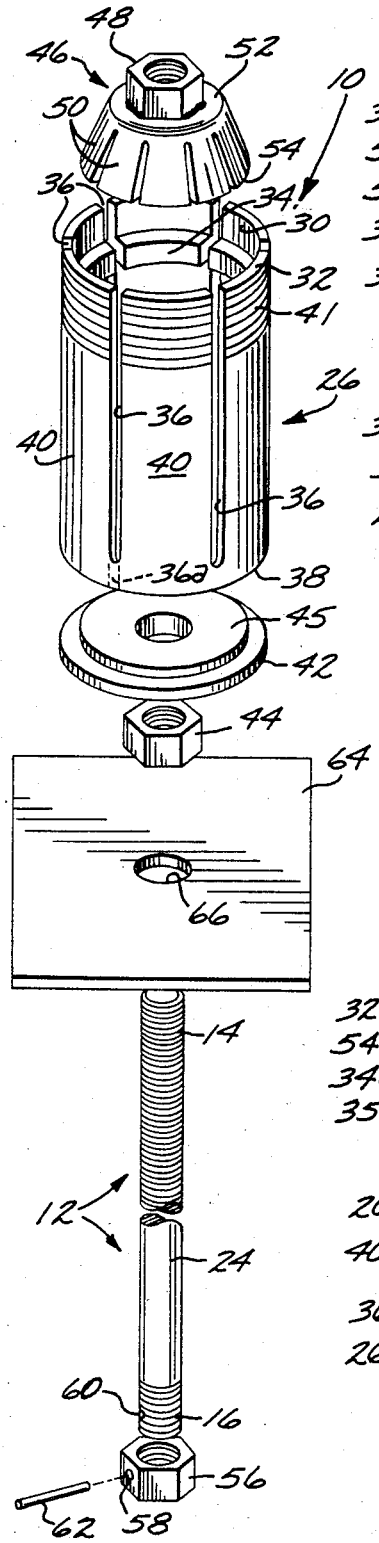
FIG. 1 is an exploded perspective view of an expansion bolt in accordance with the present invention.

Referring now to the drawings, the numeral 10 designates an expansion bolt constructed in accordance with a preferred embodiment of the present invention. The expansion bolt 10 is described herein as a roof bolt for supporting the roof of a mine tunnel. Nevertheless, it will be appreciated that the bolt 10 is readily adaptable to other applications, perhaps with minor modifications, without departing from the spirit and scope of the present invention.

The bolt 10 includes an elongate, cylindrical rod or stud 12 having a distal end 14 and a proximal end 16, both of which are threaded. When used in a roof bolt, the stud 12 will typically be somewhat more than 2 meters in length, although this can vary greatly. (The term "distal", as used herein, refers to the direction toward the inner end of a pre-drilled hole 18 in a layer of rock 20 [FIG. 4], while the term "proximal" refers to the direction toward the outer end or opening 22 of the hole 18). The distal and proximal stud ends 14 and 16, respectively, are threaded in the same direction. Extending between the ends 14 and 16 is an intermediate shank portion 24, which may be either threaded or unthreaded. In most applications, the shank portion 24 will be unthreaded, as shown in the drawings.

A cylindrical expansion sleeve 26 is carried on the stud 12 near the distal end 14 thereof. The expansion sleeve 26 is mounted so that the stud 12 passes coaxially therethrough, and the diameter of the sleeve 26 is substantially greater than the diameter of the stud 12, providing an annular space between the stud 12 and the interior surface 30 of the sleeve 26. The sleeve 26 has a distal end 32 located proximally from the distal end 14 of the stud 12. An internal lip or shoulder 34 extends radially inwardly from the interior surface 30 of the sleeve 26, a short distance proximally from the distal end 32 thereof. The shoulder 34 preferably comprises an annular member attached to the interior surface 30 by welds 35.

The sleeve 26 is provided with a plurality of axial slots 36, evenly spaced around the circumference of the sleeve, and extending axially from the distal end 32 thereof to a point distally spaced from sleeve's proximal end 38. The slots 36 divide the major portion of the sleeve's length into a plurality of circumferentially-spaced, axial segments 40. It can be seen that the slots 36 extend through the internal shoulder 34, so that the shoulder 34 has the configuration of a ring interrupted at regular intervals throughout its circumference. For some applications, it may be advantageous to have one of the slots 36 extend all the way to the proximal end 38 of the sleeve 26, as indicated by the dotted outline in FIG. 1, designated by the numeral **36*a*. The sleeve 26 has an outer surface 41 that is textured, at least near its distal end, to provide a frictional gripping surface. As shown in the drawings, this textured gripping surface may be provided by threads. The sleeve 26 is preferably formed of a steel alloy that is annealed to spring steel, for resilience, after its outer surface 40** has been suitably textured.

An annular backing plate 42 is carried on the shank portion 24 of the stud 12 in abutting relationship against the proximal end 38 of the sleeve 26. The backing plate 42 is restrained from proximal movement on the stud by suitable retention means, such as a nut 44. Alternatively, the backing plate 42 may be welded in place on the stud. It may also be formed as integral part of the sleeve 26 and held in place by the nut 44. In any case, the backing plate 42, however it is retained on the stud, restrains the sleeve 26 from axial movement along the stud in the proximal direction, while allowing free rotational movement of the stud relative to the sleeve. The backing plate 42 advantageously has a central boss 45 engageable against the interior surface 30 of the sleeve 26 to help maintain the proper axial alignment of the backing plate 42.

Threadedly attached to the distal end 14 of the stud 12 is a web-like cam element 46, the attachment advantageously being made by a nut 48 welded to the distal side of the cam element 46. Alternatively, the cam element 46 can have an integral, internally-threaded, distally-extending projection (not shown) to provide a threaded attachment to the stud. The cam element 46 has a plurality of circumferentially-spaced resilient fingers 50 that extend axially, in the proximal direction from the periphery of an annular collar 52, as best shown in FIG. 1. The fingers 50 also taper radially outwardly to give the cam element 46 a substantially frusto-conical configuration, the diameter of the cam element at the proximal ends 54 of the fingers 50 being measurably greater than its diameter at the collar 52. The proximal ends 54 of the fingers 50 extend into the open distal end 32 of the sleeve 26 and seat against the shoulder 34 therein, and are attached to the interior sleeve surface 30 by tack welds 55.

A torque application nut 56 is threadedly attached to the threaded proximal end 16 of the stud 12, as shown in FIG. 1. The nut 56 has a radial passage 58 that registers with a radial aperture 60 in the proximal end 16 of the stud 12. A shear pin 62 is inserted through the passage 58 and into the aperture 60. The shear pin 62 is formed of any suitable material, and is dimensioned to shear when a pre-determined torque is applied to the nut 56 relative to the stud 12. The maximum torque that can be applied to the nut 56 is a function of the material and dimensions of the shear pin 62. Thus, the shear pin 62 can be selected to fracture at any desired torque level, as is well known in the art. See, for example, U.S. Pat. No. 3,267,792 to Yackle. The shear pin 62 thus holds the nut 56 and the stud 12 in a fixed rotational relationship until the pre-determined torque is applied.

Carried on the stud between the torque application nut 56 and the backing plate 42 is a rock plate or pressure plate 64. The rock plate 64 has a central aperture 66 that is slightly larger in diameter than the stud 12, thereby allowing the rock plate 64 to move axially along the stud in either direction. The rock plate may be square or rectangular, as shown in the drawings, or circular. Whatever its shape, it should have a width or diameter that is larger than that of the pre-drilled hole 18.

Figure 2:
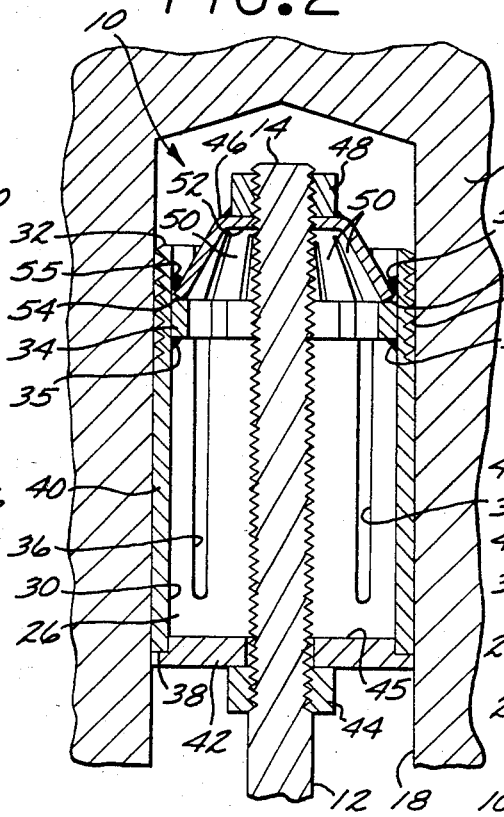
FIG. 2 is a longitudinal cross-sectional view of the expansion portion of the expansion bolt of FIG. 1, showing the expansion portion in a pre-expanded state inside a pre-drilled hole in a rock layer.

In operation, the hole 18 having been drilled into the rock layer 20 (FIG. 4), the bolt 10 is inserted into the hole 18, distal end first. The axial length of the hole 18 is preferably slightly less than the length of the stud 12, so that the proximal end 16 of the stud extends a short distance out of the hole. As best shown in FIG. 2, the diameter of the hole 18 is nearly the same as the diameter of the sleeve 26, so that when a torque is applied in a tightening direction to the torque application nut 56 (by a wrench, for example), the nut 56 and the stud 12 turn together (by means of the shear pin 62), but the sleeve 26 is restrained from rotation by its frictional engagement with the wall of the hole 18. The cam element 46, being attached to the interior of the sleeve 26 by the tack welds 55, is likewise restrained from rotation.

Figure 3:
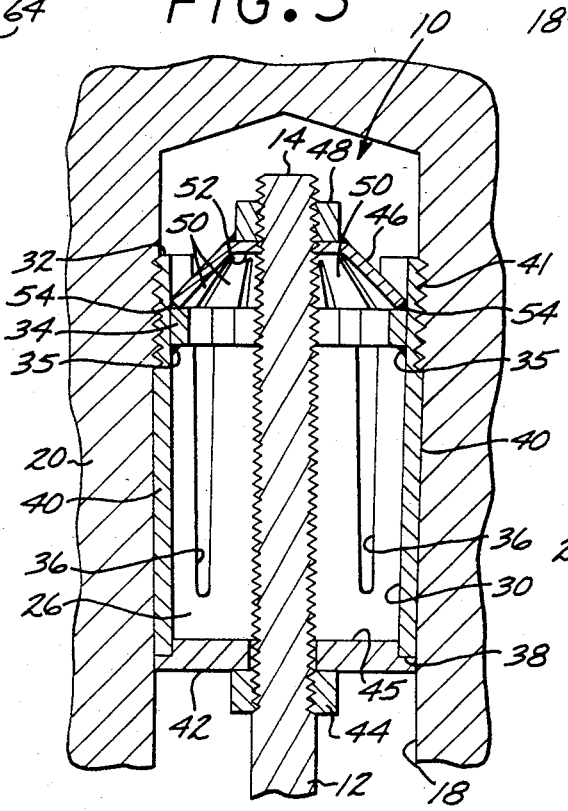
FIG. 3 is a view similar to that of FIG. 2, but showing the expansion portion after it has been expanded.

As the stud 12 is rotated, the cam element 46 is advanced in the proximal direction by means of the threaded engagement between the stud 12 and the nut 48. The sleeve 26, however, is restrained from axial movement by the backing plate 42 and its associated nut 44. As a result, the fingers 52 of the cam element 46 are urged ever more tightly against the shoulder 34, causing the cam element 46 to flatten axially, and spreading the fingers 52 radially outwardly, as shown in FIG. 3. The radially outward movement of the fingers 52 creates a camming action against the interior surface 30 of the sleeve 26, camming the engagement against the walls of the hole 18. The textured outer surface 41 of the sleeve segments 40 thus grips the wall of the hole 18 and anchors the bolt in place by virtue of the radial forces applied by the cam element 46. As the fingers 52 spread, the tack welds 55 between the finger ends 54 and the shoulder 34 may break. At this point, however, the frictional forces between the finger ends 54 and the shoulder 34 become sufficient to restrain the cam element 46 from rotation relative to the sleeve 26.

Figure 4:
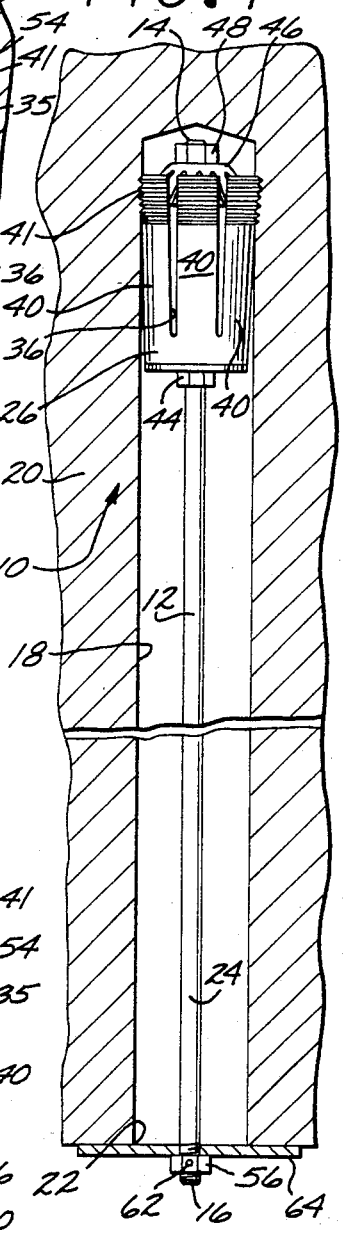
FIG. 4 is an elevational view of the expansion bolt of FIG. 1 as it appears when anchored in a pre-drilled hole in a rock layer, the rock plate being shown in cross-section.

As the sleeve segments 40 are brought to bear against the wall of the hole 18, the torque needed to rotate the stud 12 increases, until the pre-determined torque needed to break to shear pin 62 is reached. When the shear pin 62 breaks, the torque application nut 56 is allowed to rotate independently of the stud 12, thereby allowing the nut 56 to carry the rock plate 64 distally until it seats firmly against the rock shoulder around the opening 22 of the hole 18, as shown in FIG. 4. The pressure thereby applied by the rock plate against the rock shoulder produces the proper amount of longitudinal tension to the bolt, thus applying the appropriate compression to the rock layer 20.

Thus, it can be seen that the present invention provides a solid anchoring of the bolt by virtue of the evenly-distributed radial forces applied against the wall of the pre-drilled hole by means of the cam element 46 and the sleeve segments 40. In addition, by allowing the rock plate 64 to be tightened against the hole opening after the distal end of the bolt is securely anchored, a sufficient degree of longitudinal tension can be applied to the bolt to obtain the proper amount of compression of the rock layer 20. These advantages are similar to those achieved in the roof bolt which is the subject of the above- mentioned U.S. Pat. No. 4,173,918. The further advantage of the present invention is that the cam element 46, rather than being machined from a solid piece of alloy, can be stamped from sheet metal having a thickness in the range of about one-eighth inch (3.2 mm) to about one-quarter inch (6.4 mm), at a substantial cost savings. Moreover, the cam element 46 of the present invention can provide a somewhat greater degree of expansion of the sleeve segments 40 for a given amount of applied torque, as compared with the solid, conical wedge element of the prior art. This degree of expansion can be further enhanced by providing the sleeve 26 with the full-length axial slot **36*a***, as mentioned above.

Although a preferred embodiment of the invention has been described above, various modifications may suggest themselves to those skilled in the pertinent arts. Some of these modifications have been mentioned above. Another modification may be embodied, for example, in the number of sleeve segments 40. Thus, FIG. 1 shows six such segments; in practice this number may be varied from four to eight. It may even be possible to employ as few as three, and it may be desired to employ more than eight. Furthermore, the specific configuration of the cam element 46 need not be exactly as shown herein. The number and shape of the fingers 52 can be varied for example. The attachment between the fingers 52 and the internal shoulder can be made a solder joint instead of the tack welds 55. Alternatively, relative rotation between the cam element 46 and the sleeve can be restrained by seating the finger ends 54 in recesses in the distal surface of the shoulder 34, or by providing roughly-textured mating surfaces on the finger ends 54 and the shoulder 34. Finally, the shear pin 62 can be replaced by equivalent torque-limiting mechanisms that are known in the mechanical arts. These and other modifications that may suggest themselves should be considered within the spirit and scope of the present invention as defined in the claims which follow.

What is claimed is:

1. An expansion bolt for use in a pre-drilled hole of a pre-determined diameter in a structural layer, comprising:

an elongate stud having distal and proximal threaded ends;

a substantially cylindrical sleeve coaxially surrounding said stud and radially spaced therefrom near the distal end thereof, said sleeving having a plurality of axial slots extending from the distal end of said sleeve to a point distally spaced from the proximal end of said sleeve;

an internal shoulder extending radially from the interior surface of said sleeve, near the distal end of said sleeve;

first means on said stud for restraining the movement of said sleeve toward the proximal end of said stud;

a cam element threadedly attached to the distal end of said stud and having a plurality of circumferentially-spaced fingers extending proximally and radially outwardly to form a substantially frustoconical element having a greater diameter at its proximal end than at its distal end, the proximal ends of said fingers extending into the distal end of said expansion sleeve so as to be engageable with said shoulder;

a nut threadedly attached to the proximal end of said stud;

second means co-engaging said nut and said stud for holding said nut and said stud in a fixed rotational relationship until a pre-determined torque is applied to said nut; and a plate carried on said stud between said nut and said first means so as to be axially movable thereon, and having a width larger than the diameter of said pre-drilled hole;

whereby said fingers of said cam element spread radially outwardly against the interior surface of said sleeve to cam the slotted portion of said sleeve radially outwardly as said nut and said stud are rotated together in a preselected direction, and whereby said second means allows said nut to be rotated in said preselected direction independently of said stud after said predetermined torque is applied, thereby to move said nut distally on said stud.

2. The expansion bolt of claim 1, wherein said sleeve includes an axial slot that extends through the entire length of said sleeve.

3. The expansion bolt of claim 1, wherein said first means allows said stud to rotate independently of said sleeve.

4. The expansion bolt of claim 3, wherein said first means comprises:

a backing plate freely rotatable on said stud and engageable against the proximal end of said sleeve; and means on said stud for restraining said backing plate from moving in the proximal direction on said stud.

5. The expansion bolt of claim 3, wherein said cam element is connected to said sleeve so that said stud is rotatable relative to both said sleeve and said cam element.

6. The expansion bolt of claim 5, wherein said cam element is welded to the interior surface of said sleeve.

7. The expansion bolt of claim 1, wherein said second means comprises:

a radial aperture in said proximal end of said stud;

a radial passage through said nut, said passage being registrable with said aperture; and a shear pin passing through said passage and into said aperture, said shear pin being dimensioned so as to be fractured when said predetermined torque is applied to said nut.

8. The expansion bolt of claim 1, wherein said cam element is formed from a sheet metal stamping.

9. An expansion bolt, of the type including an elongate stud with distal and proximal threaded ends a substantially cylindrical expansion sleeve co-axially carried on said stud and divided into a plurality of circumferentially-spaced axial segments, restraining means co-engaging said stud and the proximal end of said sleeve for restraining said sleeve from moving proximally on said stud, and camming means threadedly attached to the distal end of said stud and engageable against the interior surface of said expansion sleeve, whereby said stud is rotatable relative to said sleeve and said camming means, and whereby said camming means forces said sleeve segments radially outwardly as said stud is rotated relative thereto, characterized in that said camming means comprises:

a piece of sheet metal formed into a substantially frusto-conical member with an annular collar and a plurality of circumferentially-spaced fingers extending axially from the periphery of said collar and tapering radially outwardly therefrom, so that the diameter of said frusto-conical member is greater at the ends of said fingers than at said collar, said collar being threadedly attached to the distal end of said stud, and the ends of said fingers extending proximally into said sleeve so as to be engageable against the interior surface of said sleeve, whereby the rotation of said stud relative to said sleeve and said frusto-conical member axially flattens said member to spread said fingers radially outwardly against the interior surface of said sleeve, thereby camming said sleeve segments radially outwardly.

10. The expansion bolt of claim 9, wherein said sleeve includes a substantially annular shoulder extending radially inwardly from the interior surface of said sleeve, the ends of said fingers of said frusto-conical member being in engagement with said shoulder.

11. The expansion bolt of claim 10, wherein said shoulder is near the distal end of said sleeve, and wherein the ends of said fingers are welded to the interior surface of said sleeve.

12. The expansion bolt of claim 9, further comprising:

first means at the proximal end of said stud adapted to have a torque applied thereto, second means, co-engageable with said stud and said first means, for holding said first means and said stud in a fixed rotational relationship until a predetermined torque is applied to said first means; and a pressure plate carried on said stud between said first means and said sleeve.

13. The expansion bolt of claim 12, wherein said first means is a nut threadedly attached to the distal end of said stud, and wherein said second means includes a shear pin co-engageable with said nut and said stud, said shear pin being dimensioned to fracture upon the application of said predetermined torque to said nut.

14. The expansion bolt of claim 9, wherein said restraining means comprises:

a backing plate mounted on said stud so as to be freely rotatable thereon and engageable against the proximal end of said sleeve; and means co-engaging said backing plate and said stud for restraining said backing plate from moving axially on said stud in the proximal direction.

15. The expansion bolt of claim 14, wherein said means co-engaging said backing plate and said stud includes a nut threadedly attached to said stud and engageable against said backing plate.

16. The expansion bolt of claim 9, wherein said sleeve segments are circumferentially spaced by a plurality of slots extending axially through said sleeve from the distal end thereof to a point distally spaced from the proximal end thereof.

17. The expansion bolt of claim 16, wherein said sleeve includes an axial slot extending the entire length of said sleeve.

18. An expansion bolt for use in a pre-drilled hole of predetermined diameter in a structural layer comprising:

an elongate stud having distal and proximal threaded ends and an intermediate shank portion, said distal end being adapted for insertion into said hole, and said proximal end extending outside of said hole;

a substantially cylindrical expansion sleeve coaxially mounted on said stud near the distal end thereof, said sleeve having a distal end and a proximal end and a plurality of circumferentially-spaced slots extending from said distal sleeve end to a point distally spaced from said proximal sleeve end, thereby forming a plurality of circumferentially spaced, axial sleeve segments;

an internal shoulder extending radially inwardly from the interior surface of said sleeve near the distal end thereof;

a backing plate mounted on said stud so as to be restrained from moving axially in a proximal direction on said stud, said backing plate being engageable with the proximal end of said sleeve, whereby said stud, said backing plate, and said sleeve are co-engaged in a manner which allows said stud to be rotated independently of said sleeve;

a cam element threadedly attached to the distal end of said stud and having an annular collar at its distal end and a plurality of circumferentially spaced resilient fingers extending proximally and radially outwardly from the periphery of said collar to form a substantially frusto-conical element having a greater diameter at the ends of said fingers than at said collar, the ends of said fingers extending into the distal end of said sleeve so as to engage said shoulder;

first means on the proximal end of said stud adapted to have a torque applied thereto;

second means, co-engageable with said first means and said stud, for preventing said first means from rotating independently of said stud upon the application of a torque until a predetermined torque level is reached;

third means, co-engaging said fingers of said cam element and the interior surface of said sleeve, for restraining relative rotation therebetween as said stud is rotated by the application of a torque to said first means; and a pressure plate carried on said stud between said first means and said backing plate and having a width greater than the diameter of said hole, said pressure plate being axially movable on said stud in response to engagement by said first means;

whereby said fingers of said cam element spread radially outwardly against the interior surface of said sleeve to cam said sleeve segments radially outwardly as said first means and said stud are rotated together by the application of a torque to said first means, and whereby said second means allows said first means to be rotated independently of said stud after said predetermined torque level has been applied, thereby to move first means axially on said stud in a distal direction to engage said pressure plate.

19. The expansion bolt of claim 18, wherein said sleeve and said cam element are formed from a resilient steel alloy.

20. The expansion bolt of claim 19, wherein said cam element is formed from a sheet metal stamping having a thickness in the range of about one-eighth to about one-quarter inch.

* * * * *

UNITED STATES PATENT AND TRADEMARK OFFICE

CERTIFICATE OF CORRECTION

PATENT NO. : 4,592,687

DATED : June 3, 1986

INVENTOR(S) : Raymond Piersall

It is certified that error appears in the above-identified patent and that said Letters Patent are hereby corrected as shown below:

Column 6, line 3, after "camming the", insert --segments 40 thereof radially outwardly into a firm--.

Column 7, line 28, change "frustoconical" to --frusto-conical--.

Signed and Sealed this

*Nineteenth* Day of *August 1986*

[SEAL]

*Attest:*

DONALD J. QUIGG

*Attesting Officer*

*Commissioner of Patents and Trademarks*